US006481768B1

(12) United States Patent
Fu

(10) Patent No.: US 6,481,768 B1
(45) Date of Patent: Nov. 19, 2002

(54) BALL-PICKING DEVICE

(76) Inventor: Chi-Fong Fu, At the Hwa Dah Hong Electric (Dong Guang) Company, Ltd. Southern Industry Area, Hakong, Chang an Town, Dong Guang City, Guang Dong Province (CN)

( * ) Notice: Subject to any disclaimer, the term of this patent is extended or adjusted under 35 U.S.C. 154(b) by 0 days.

(21) Appl. No.: 09/947,548

(22) Filed: Sep. 7, 2001

(51) Int. Cl.[7] ..... A63B 47/02
(52) U.S. Cl. ..... 294/19.2
(58) Field of Search ..... 294/19.1, 19.2, 294/99.1; 56/327.1, 328.1, 332; 414/440; 473/286

(56) References Cited

U.S. PATENT DOCUMENTS 721,196 A * 2/1903 Jeffreys ..... 294/19.2
2,736,157 A * 2/1956 Weathersby ..... 294/19.2 X
2,749,697 A * 6/1956 Poche ..... 294/19.2 X
2,835,099 A * 5/1958 Touchberry ..... 294/19.21 X
2,972,851 A * 2/1961 Goehring ..... 294/19.2 X
3,215,293 A * 11/1965 Kelly et al. ..... 294/19.2 X
3,265,430 A * 8/1966 Jenkins ..... 294/19.2
3,982,781 A * 9/1976 Tucker et al. ..... 294/19.2
4,322,939 A * 4/1982 McDonald ..... 294/19.2 X
4,412,697 A * 11/1983 Verde ..... 294/19.2
5,326,145 A * 7/1994 Lee ..... 294/19.2

* cited by examiner

*Primary Examiner*—Johnny D. Cherry
(74) *Attorney, Agent, or Firm*—Liniak, Berenato & White, LLC

(57) ABSTRACT

A ball-picking device is used to pick up a ball on a ground surface, and includes a basket frame unit which confines a ball receiving space and which has a ground contacting side formed with a plurality of ball-extension gaps that are in spatial communication with the ball receiving space. Each of the ball-extension gaps is confined by a pair of deformable rod units, and is slightly narrower than a diameter of the ball such that when the ground contacting side of the basket frame unit is moved toward the ground surface to register the ball with one of the ball-extension gaps, the deformable rod units that define a respective one of the ball-extension gaps will be pushed apart and will be deformed by the ball so as to enlarge the respective ball-extension gap and permit extension of the ball into the ball receiving space.

3 Claims, 6 Drawing Sheets

BALL-PICKING DEVICE

BACKGROUND OF THE INVENTION

1. Field of the Invention

The invention relates to a ball-picking device, more particularly to an easy-to-operate ball-picking device for picking up a ball, such as a golf ball, on a ground surface.

2. Description of the Related Art

Referring to FIG. 1, a conventional ball-picking device 8 for picking up a ball 83 on a ground surface is shown to include a cup 82 which confines a ball receiving space 821, and which has an annular peripheral edge defining an opening 822 of a diameter greater than the diameter of the ball 83. A handle 81 is connected to the cup 82 to facilitate operation of the same for picking up the balls 83 on the ground surface.

It is noted that adequate skill is required to operate the aforesaid conventional ball-picking device 8 since precise aiming of the ball 83 relative to the opening 822 is needed. Moreover, the operation of the ball-picking device 8 when picking up the ball 83 is laborious because a relatively large force is required to press the cup 82 against the ball 83 such that the latter can extend into the ball receiving space 821. Furthermore, the ball receiving space 821 cannot contain a large number of the balls 83, thereby increasing the burden of the ball pick-up operation.

SUMMARY OF THE INVENTION

Therefore, the object of the present invention is to provide a ball-picking device that is capable of overcoming the aforementioned problems.

According to the present invention, a ball-picking device for picking up a ball on a ground surface includes a basket frame unit and a handle member. The basket frame unit confines a ball receiving space, and has a ground contacting side formed with a plurality of ball-extension gaps that are in spatial communication with the ball receiving space. Each of the ball-extension gaps is confined by a pair of deformable rod units. Each of the ball-extension gaps is slightly narrower than a diameter of the ball such that when the ground contacting side of the basket frame unit is moved toward the ground surface to register the ball with one of the ball-extension gaps, the deformable rod units that define said one of the ball-extension gaps will be pushed apart and will be deformed by the ball so as to enlarge the respective one of the ball-extension gaps and so as to permit extension of the ball into the ball receiving space. The handle member is connected to the basket frame unit.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
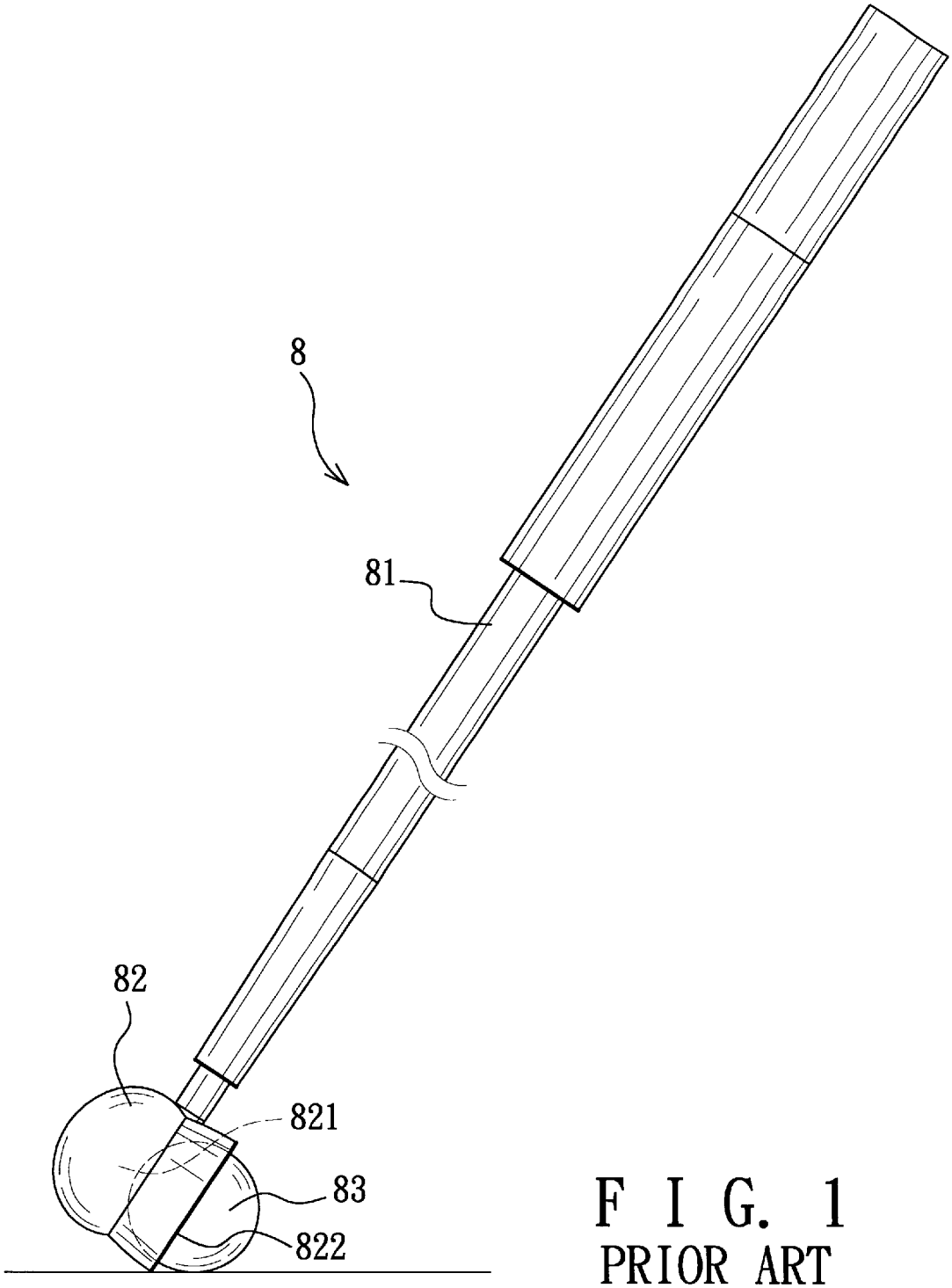
F I G. 1 PRIOR ART
FIG. 1 is a schematic view of a conventional ball-picking device for picking up a ball.
Figure 2:
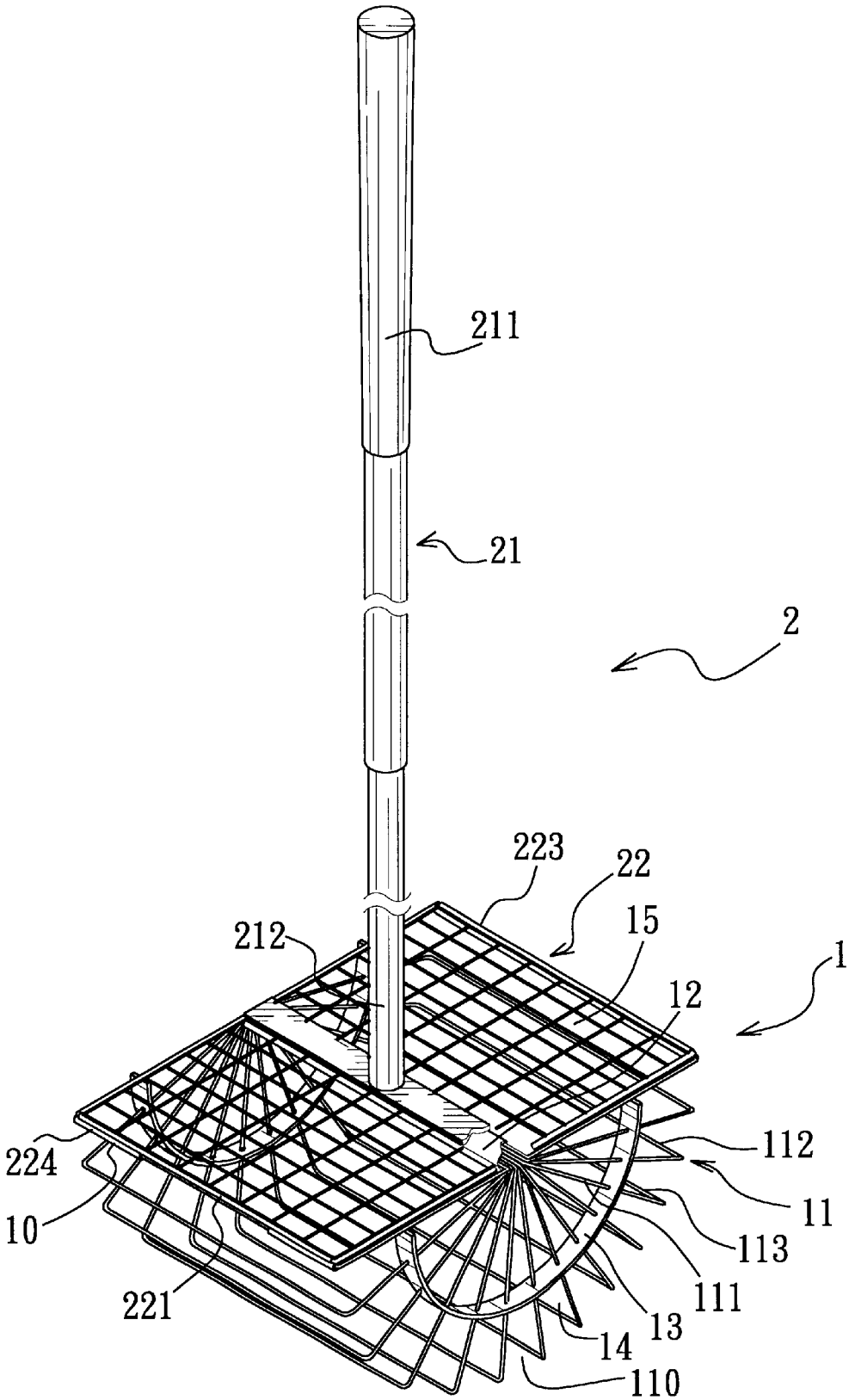
FIG. 2 is a perspective view of a preferred embodiment of a ball-picking device for picking up a ball on a ground surface.

Before the present invention is described in greater detail with reference to the following preferred embodiments, it should be noted that same reference numerals have been used to denote similar elements throughout the specification.

FIGS. 2 to 5 illustrate a preferred embodiment of a ball-picking device which serves the purpose of picking up balls 4, such as golf balls, on a ground surface 3. The device of the preferred embodiment includes a basket frame unit 1 and a handle member 2.

Figure 3:
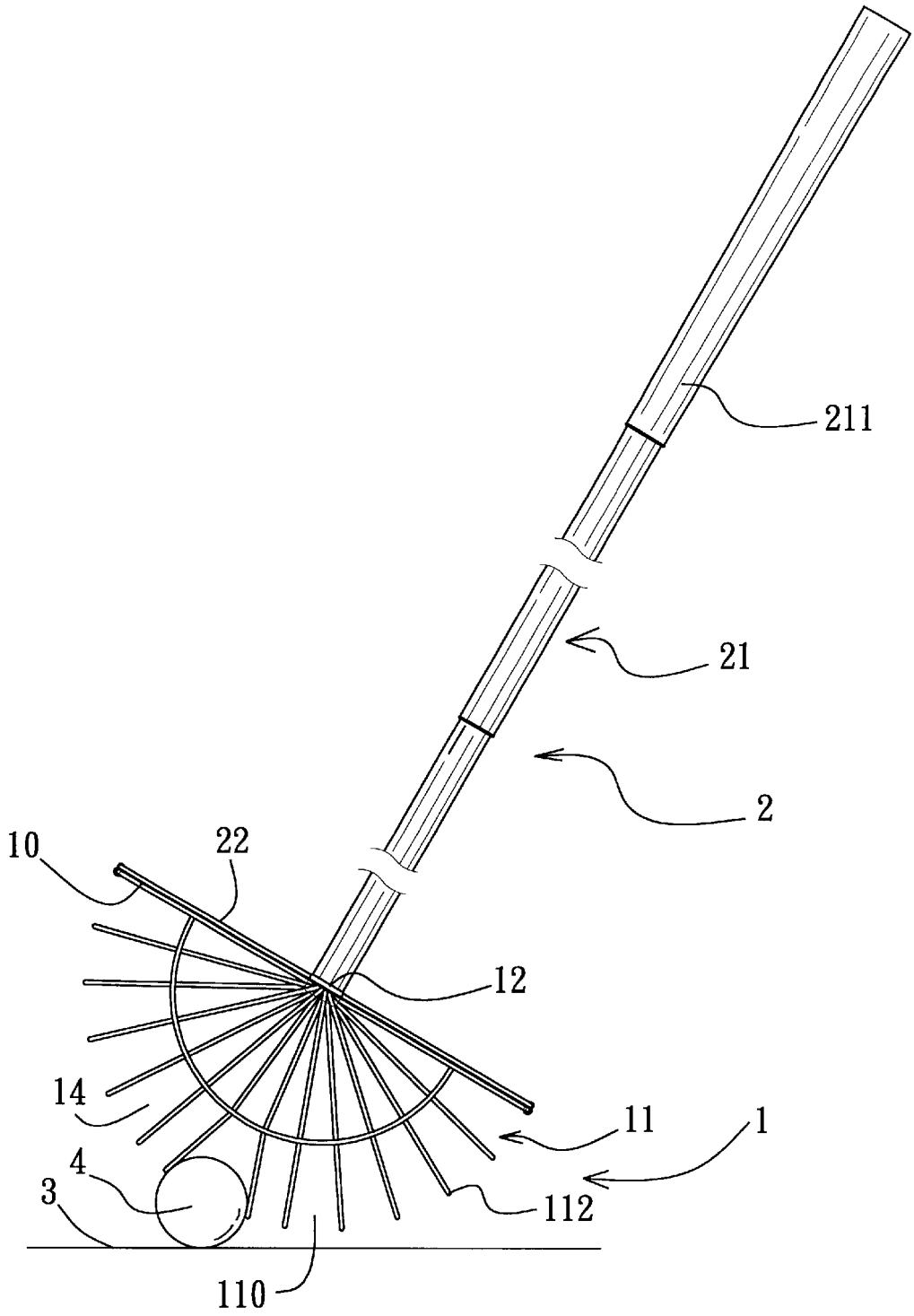
FIG. 3 is a schematic view of the preferred embodiment, illustrating how the ball is squeezed into a ball-receiving space of the preferred embodiment.
Figure 4:
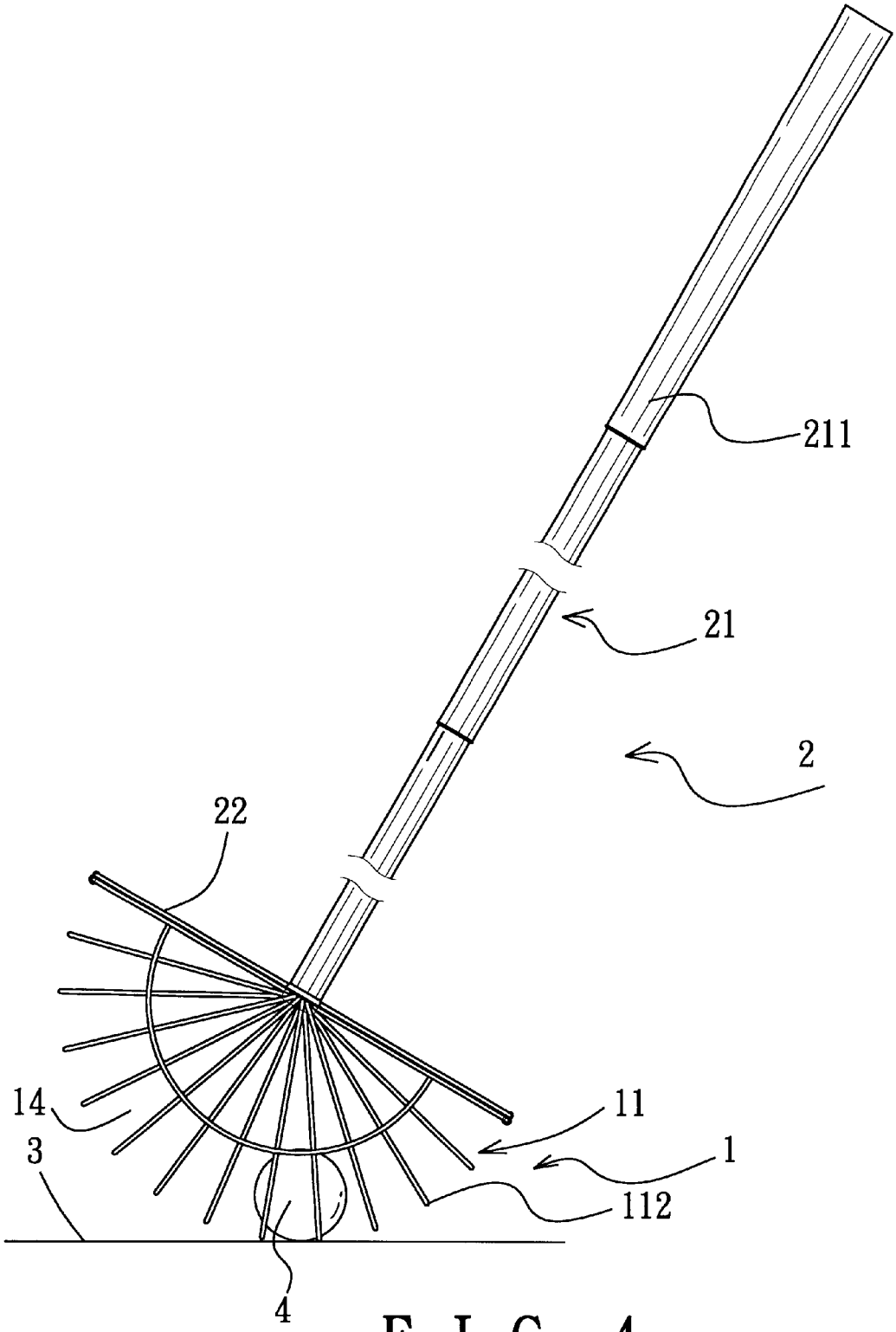
FIG. 4 is a schematic view of the preferred embodiment, illustrating the ball is collected in the ball-receiving space of the preferred embodiment.

As illustrated, the basket frame unit 1 confines a ball receiving space 14, and has a ground contacting side 112 formed with a plurality of ball-extension gaps 110 that are in spatial communication with the ball receiving space 14. Each of the ball-extension gaps 110 is confined by a pair of deformable rod units 11. Each of the ball-extension gaps 110 is slightly narrower than a diameter of the ball 4 such that when the ground contacting side 112 of the frame unit 1 is moved toward the ground surface 3 to register the ball 4 with one of the ball-extension gaps 110, the deformable rod units 11 that define a respective one of the ball-extension gaps 110 will be pushed apart and will be deformed by the ball 4, as best shown in FIG. 3, so as to enlarge the respective ball-extension gap 110 and so as to permit extension of the ball 4 into the ball receiving space 14 (see FIG. 5).

The handle member 2 is connected to the basket frame unit 1.

Each of the rod units 11 is generally U-shaped and is preferably made of metal, such as stainless steel. Each of the rod units 11 includes parallel left and right rods 111 with top and bottom ends, and a transverse rod 113 which interconnects the bottom ends of the left and right rods 111. The transverse rods 113 of an adjacent pair of the rod units 11 define a respective one of the ball-extension gaps 110.

The frame unit 1 further includes a rectangular top frame member 10 that is connected to the top ends of the left and right rods 111 of the rod units 11 and that defines an opening 15 to permit fetching of the balls 4 that are disposed in the ball receiving space 14. Preferably, the transverse rods 111 of the rod units 11 are angularly spaced apart from each other and configure the ground contacting side 112 of the frame unit 1 with a curved contour. In this embodiment, the ground contacting side 112 of the basket frame unit 1 has a semi-circular contour.

The frame unit 1 further includes a left arcuate positioning strip 13 which interconnects the left rods 111 of the rod units 11, and a right arcuate positioning strip 13 which interconnects the right rods 111 of the rod units 11. Each of the left and right arcuate positioning strips 13 is formed with a plurality of angularly spaced apart retaining holes which permit a respective set of the left and right rods 111 of the rod units 11 to extend fittingly therethrough.

The top frame member 10 is provided with a mounting seat 12 that partitions the opening 15 into first and second portions. The top ends of the left and right rods 111 of each of the rod units 11 are connected to the mounting seat 12 such that the rod units 11 extend in radial directions from the mounting seat 12. A cover unit 22 is mounted movably on the top frame member 10 for covering selectively the opening 15.

The handle member 2 includes a shaft 21 having an upper grip end 211 and a lower mounting end 212 connected to the cover unit 22. Preferably, the shaft 21 is a telescopic shaft.

Figure 5:
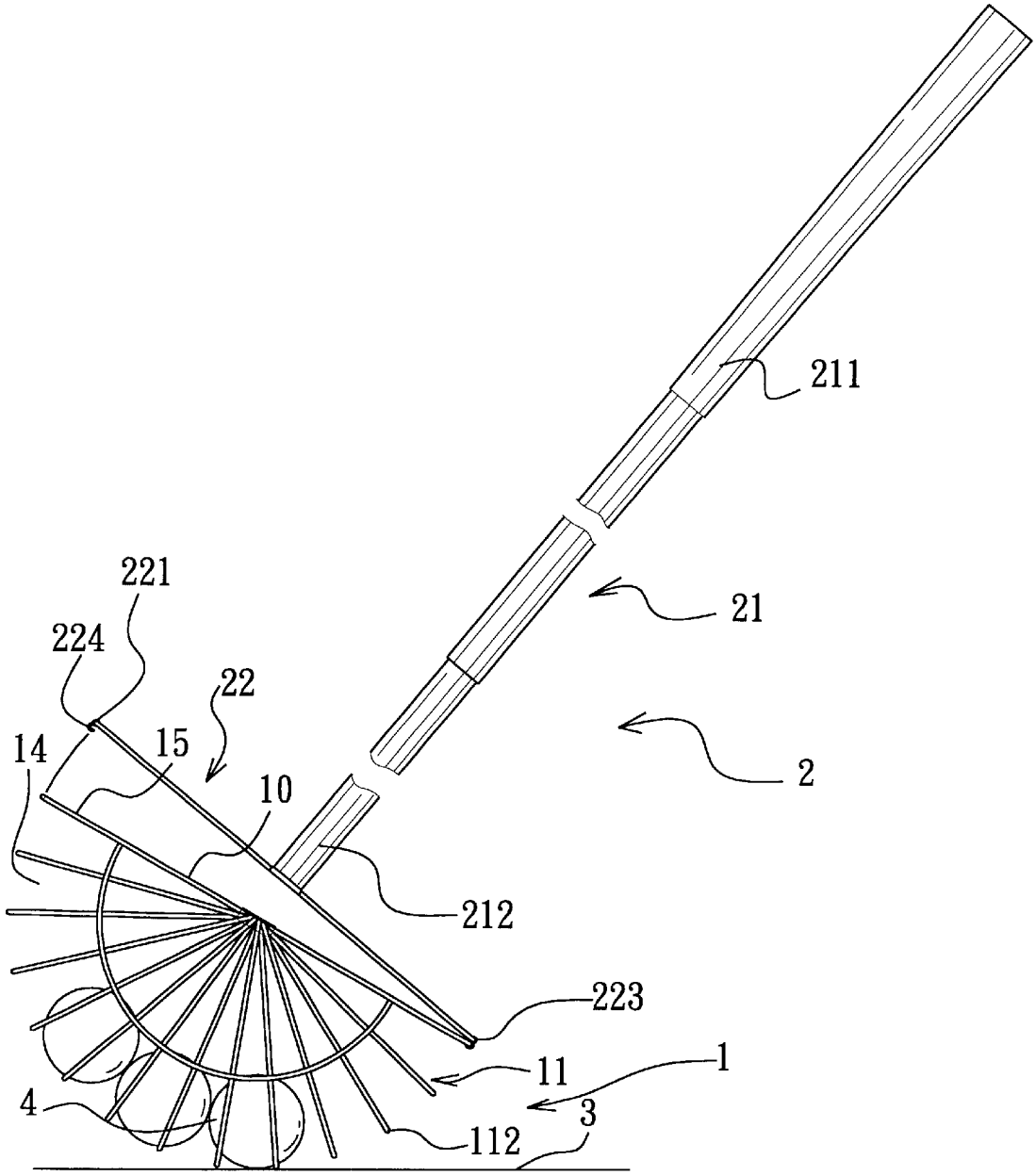
FIG. 5 is a schematic view of the preferred embodiment, illustrating how a cover unit is opened relative to a top frame member of the preferred embodiment for fetching the balls that are collected in the ball receiving space.

In this preferred embodiment, the cover unit 22 has a pivot end portion 223 connected pivotally to one side of the top frame member 10, and a fastening end portion 221 provided with a fastener 224 for engaging removably the other side of the top frame member 10, as best shown in FIG. 5.

Figure 6:
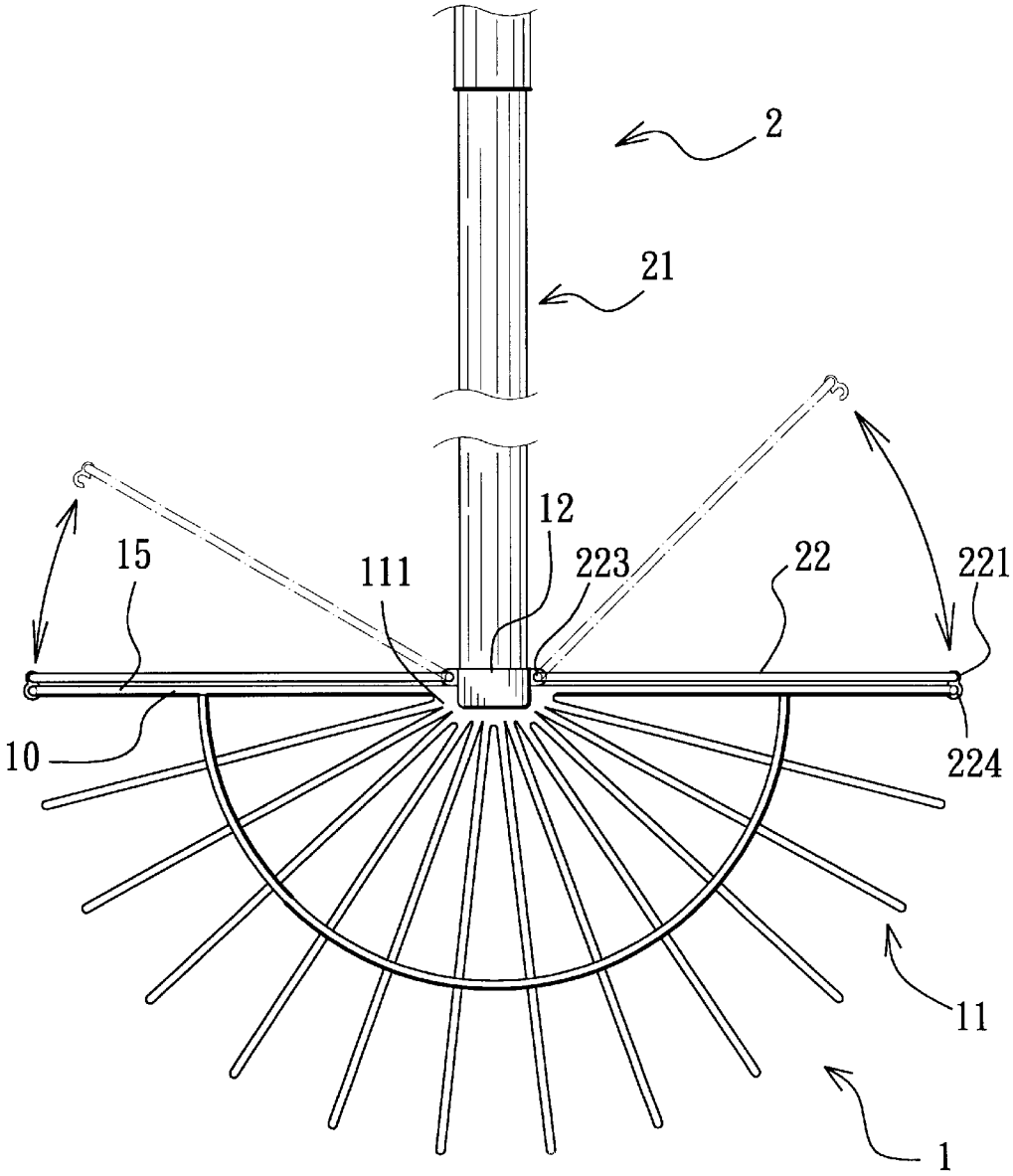
FIG. 6 is a fragmentary schematic view of a modified preferred embodiment, illustrating how a cover unit is opened relative to a top frame member of the modified preferred embodiment for fetching the balls that are collected in the ball receiving space.

Referring to FIG. 6, a modified preferred embodiment of the present invention is shown to have a structure generally similar to that of the previous embodiment. The main difference resides in that the cover unit 22 includes first and second cover parts, each of which has a pivot end portion 223 connected pivotally to the mounting seat 12, and a fastening end portion 221 provided with a fastener 224 for engaging removably the top frame member 10. In addition, the lower mounting end of the handle member 2 is connected to the mounting seat 12.

With the invention thus explained, it is apparent that various modifications and variations can be made without departing from the spirit of the present invention. It is therefore intended that the invention be limited only as recited in the appended claims.

I claim:

1. A ball picking device for picking up a ball on a ground surface, comprising:

a basket frame unit confining a ball receiving space, and having a ground contacting side formed with a plurality of ball-extension gaps that are in spatial communication with said ball receiving space, each of said ball-extension gaps being confined by a pair of deformable rod units, wherein each of said rod units is generally U-shaped and includes parallel left and right rods with top and bottom ends, and a transverse rod which interconnects said bottom ends of said left and right rods, said transverse rods of an adjacent pair of said rod units defining a respective one of said ball-extension gaps, each of said ball-extension gaps being slightly narrower than a diameter of the ball such that when said ground contacting side is moved toward the ground surface to register the ball with one of said ball-extension gaps, said deformable rod units that define said one of said ball-extension gaps will be pushed apart and will be deformed by the ball so as to enlarge said one of said ball-extension gaps and so as to permit extension of the ball into said ball receiving space;

a top frame member that is connected to said top ends of said left and right rods of said rod units and that defines an opening to permit fetching of the ball that is disposed in said ball receiving space, said top frame member having a mounting seat that partitions said opening into first and second portions;

a cover unit mounted movably on said top frame member for covering selectively said opening, said cover unit having first and second cover parts, each of which has a pivot end portion connected pivotally to said mounting seat, and a fastening end portion provided with a fastener for engaging removably said top frame member; and a handle member connected to said basket frame unit.

2. The ball-picking device as defined in claim 1, wherein said handle member includes a shaft with an upper grip end and a lower mounting end connected to said mounting seat.

3. The ball-picking device as defined in claim 2, wherein said shaft is a telescopic shaft.

* * * * *